US005963184A

United States Patent [19]

Tokunaga et al.

[11] Patent Number: 5,963,184

[45] Date of Patent: Oct. 5, 1999

[54] METHOD FOR DRIVING A PLASMA DISPLAY

[75] Inventors: Tsutomu Tokunaga; Kenichi Kobayashi, both of Koufu, Japan

[73] Assignee: Pioneer Electronic Corporation, Tokyo, Japan

[21] Appl. No.: 08/923,950

[22] Filed: Sep. 5, 1997

[30] Foreign Application Priority Data

Sep. 6, 1996 [JP] Japan ..... 8-257652

[51] Int. Cl.[6] ..... G09G 3/28

[52] U.S. Cl. ..... 345/60; 345/208; 315/169.4

[58] Field of Search ..... 345/60, 61, 62, 345/63, 66, 67, 208, 209, 210, 204; 315/169.4, 169.1, 169.2

[56] References Cited

U.S. PATENT DOCUMENTS 5,684,499 11/1997 Shimizu et al. ..... 345/60

5,818,419 10/1998 Tajima et al. ..... 345/63

5,854,540 12/1998 Matsumoto et al. ..... 345/204

*Primary Examiner*—Xiao Wu

*Attorney, Agent, or Firm*—Morgan, Lewis Bockius LLP

[57] ABSTRACT

A method for driving a matrix type of plasma display panel displaying an image with a stable display operation in error-discharge free. The last pulse of the discharge-sustaining pulses in the sustained discharge period is adjusted to be shorter than that of the immediately previous pulse of the discharge-sustaining pulses and/or an address-pulse is applied to the column electrode in the simultaneous time of the applying of the discharge-sustaining pulses to generate the discharge between the paired row and column electrodes. The residual wall charges remaining the lightened pixel cell and the darkened pixel cell are uniformed at the end of sustained discharge period so that a stable addressing operation and precise emission displaying associated with the pixel data is achieved in the next addressing period.

7 Claims, 9 Drawing Sheets

COLUMN ELECTRODES D1~Dm 0
DP1
DP2
---
DPn

ROW ELECTRODES X1~Xn 0
IPx
RPx

1ST ROW ELECTRODE Y1 0
IPy
RPy
SP

2ND ROW ELECTRODE Y2 0
IPy
RPy
SP

N-TH ROW ELECTRODE Yn 0
IPy
RPy
SP
(A)
(B)
(C)
SIMULTANEOUS RESETTING PERIOD
ADDRESSING PERIOD
SUSTAINED DISCHARGE PERIOD

METHOD FOR DRIVING A PLASMA DISPLAY

BACKGROUND OF THE INVENTION

1. Field of the Invention

This invention relates to a method for driving a surface discharge and matrix type of plasma display panel (also designated as a PDP hereinafter).

2. Description of Related Art

The plasma display panel is well known as one of thin two-dimensional displays, and various researches and studies have recently been conducted on the plasma display panels. An AC discharge and matrix type of plasma display panel having a memory function is well known as one of such plasma display panels. FIG. 1 shows a schematic diagram of a plasma display apparatus including a plasma display panel.

Referring to FIG. 1, a driving apparatus 100 receives video signals and converts a set of the received video signals every one pixel to digital pixel data. The driving apparatus 100 then generates pixel data pulses corresponding to the pixel data to apply the pixel data pulses to column electrodes Dl to Dm in the plasma display panel 11. The PDP 11 comprises the column electrodes D1 to Dm, and row electrodes X1 to Xn and Y1 to Yn extending perpendicularly to the column electrodes, in which two adjacent ones of the row electrodes Xi and Yi are paired to one another to form a row of the display on the display panel. The PDP further includes a dielectric layer formed between the column and row electrodes. A cross section in which a pair of row electrodes and a column electrode are crossed to each other constitutes a single pixel cell.

The driving apparatus 100 produces priming pulses PPx and PPy for all of the row electrodes in the PDP 11 and then applies the pulses PPx and PPy to the respective row electrodes X1 to Xn, and Y1 to Yn to forcibly cause a discharge between a pair of row electrodes Xi and Yi for generating (or destroying) a wall charge within the pixel cell. The driving apparatus 100 also generates a scan pulse SP for writing the pixel data in the PDP 11, and discharge-sustaining pulses IPx and IPy for sustaining a discharge emission, an erasing pulse EP for ceasing a sustained discharge emission, thereby applying these pulses to the row electrodes X1 to Xn, and Y1 to Yn in the PDP 11.

FIGS. 2A to 2E show the timing charts for applying the above various types of driving pulses to the various electrodes to illustrate the suggested method for driving the PDP.

Referring to FIGS. 2A to 2E, the driving apparatus 100 supplies all of the row electrodes X1 to Xn with the priming pulses PPx which have a negative potential, and simultaneously supplies all of the row electrodes Y1 to Yn with the priming pulses PPy which have a positive potential. The application of the priming pulses causes discharges between the pair of row electrodes in all of the pixel cells of the PDP 11. The discharge produces charged particles in each of the pixel cells. After the disappearance of the discharge, the wall charge remains in the dielectric layer (simultaneous resetting step). The priming pulses PPx, PPy with a long time constant are used for suppressing the discharge emission non-related to the displaying due to themselves to improve the contrast.

The driving apparatus 100 then applies pixel-data pulses DP1 to DPn corresponding to pixel data at every row to the column electrodes D1 to Dm in turn. In this case, these pixel data pulses DP1 imply pulses of the number of "m" corresponding to pixel data for ranging from the first column to the m-th column in the first row. The pixel data pulses DP2 imply pulses of the number of "m" corresponding to pixel data for ranging from the first column to the m-th column in the first second row.

The pixel data pulses corresponding to pixel data for the "m" pieces in number are applied to the column electrodes D1 to Dm at the same time respectively. For example, for the column electrodes to have contents of the pixel data equal to a logical value "0", the positive voltage pixel data pulses are applied to such column electrodes. On the other hand, for the column electrodes to have contents of the pixel data equal to a logical value "1", no voltage pixel data pulses is applied to such column electrodes. The driving apparatus 100 generates the scan pulse SP and applies them in turn to the row electrodes Y1 to Yn with the timing for applying the pixel data pulses DP1 to DPn to the column electrodes thereby to perform to write the pixel data to every row (addressing period or step).

In the addressing period, the pixel cells each having a column electrode D to which the scan pulse SP and the positive voltage pixel data pulse may be applied at the same time are discharged and excited, so that most of the wall charges which has been generated by simultaneous resetting step disappears. As a result, in the period (B) appearing in FIGS. 2A to 2E respectively, a very small amount of the positive wall charges remains at the side of the row electrodes Y and, a very small amount of the negative voltage wall charges remains at the side of the column electrodes D as shown in FIG. 3B.

On the contrary, the wall charges which have been generated by simultaneous resetting step charges may remain at the row electrodes as they are as shown in FIG. 4B even in the addressing period for writing the pixel data pulses, when only the scan pulses SP are applied to the row electrodes but any pixel data pulse is not applied to the column electrodes so that no discharge occurs at the pixels.

Next, The driving apparatus 100 then repeatedly applies a series of discharge-sustaining pulses IPx, each of which has a positive voltage, to the row electrodes X1 to Xn, and also repeatedly applies a series of other discharge-sustaining pulses IPy, each of which has a positive voltage, to the row electrodes Y1 to Yn at offset timings from those of the former discharge-sustaining pulses IPx. The only pixel cells which hold the wall charge maintain the discharge emissions (sustained discharge period).

In this case, the only pixel cells which hold many wall charges maintain the discharge emissions every time the discharge-sustaining pulses IPx and IPy are applied thereto in the period (B) appearing in FIGS. 2A to 2E. In other words, the state of the wall charges shown in FIG. 4B is kept during the period (C) appearing in FIGS. 2A to 2E as shown in FIG. 4C, so that the pixel cells perform the discharge and emit light whenever the discharge-sustaining pulses IPx and IPy are applied thereto.

On the other hand, the pixel cells which hold the state of the wall charges shown in FIG. 3B do not discharge because of a very small amount of the wall charges. The state of the wall charges shown in FIG. 3B is kept as it is, as shown in FIG. 3C.

In the method for driving a surface discharge and matrix type of PDP, a one cycle for displaying an image consists of the simultaneous resetting step, the addressing step, the sustained discharge step is repeated. Therefore, after the sustained discharge period is ended, the simultaneous resetting step is started again. At the time the sustained discharge period is just ended, there are some pixel cells lightened by the sustained discharge and the other pixel cells darkened due to non-sustained discharge respective having the states of the wall charges shown in FIGS. 3C and 4C respectively. Accordingly, there are different states of the wall charges even after the simultaneous resetting step for forming the wall.

The different states of the wall charges in the pixel cells constructing the display panel causes the addressing step unstable in operation to disturb the accurate displaying of the image.

SUMMARY OF THE INVENTION

The main object of the invention is to provide a method for driving a matrix type of plasma display panel which is able to indicate in stable a precise emission display associated with the pixel data.

The aforementioned problems are overcome and advantages are provided by a method for driving a matrix type of plasma display panel displaying an image according to the present invention, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel, said method comprising the steps of:

applying selectively a pixel data pulse to the column electrode while synchronously applying a scan pulse to every pair of row electrodes to write pixel data to the associated pixels for selecting a pixel cell to be lightened or darkened in accordance with pixel data pulses applied for an addressing period; and applying a series of discharge-sustaining pulses alternately to one of the paired row electrodes and the other thereof to maintain sustained discharge between the pair of row electrodes and the lightened or darkened pixel cell for a sustained discharge period wherein a width of a last pulse of the discharge-sustaining pulses applied in the sustained discharge period shorter than that of an immediately previous pulse in the sustained discharge period;

applying an address-pulse to the column electrode at the same time the last discharge-sustaining pulse is applied to generate a discharge between the paired row electrodes and the column electrode.

In a second aspect of the present invention, the method for driving a matrix type of plasma display panel is characterized in that said address-pulse has the same polarity of said discharge-sustaining pulse.

In a third aspect of the present invention, the method for driving a matrix type of plasma display panel is characterized in that the method further comprising the steps of adjusting the width of the previous pulse applied immediately before the last discharge-sustaining pulse finally applied in the sustained discharge period; and adjusting an interval between the end of the immediately previous pulse and the beginning of the last pulse.

In a fourth aspect of the present invention, the method for driving a matrix type of plasma display panel is characterized in that the method further comprising the steps of, before the addressing period, applying a first resetting pulses to all of the row electrodes simultaneously to cause discharges between all of the pairs of row electrodes to make the wall charges in the pixel cells, each first resetting pulse including a pulse rise or pulse fall time longer than each duration of the discharge-sustaining pulse as a simultaneous resetting period.

In a fifth aspect of the present invention, the preceding method for driving a matrix type of plasma display panel is characterized in that the wall charges formed in the simultaneous resetting step are selectively deleted by applying both the scan pulse and the pixel data in the addressing to select the lightened pixel cell and the darkened pixel cell.

In a sixth aspect of the present invention, the preceding method for driving a matrix type of plasma display panel is characterized in that the method further comprising the steps of, immediately after applying the first resetting pulse, applying a second resetting pulse to one of the paired row electrodes in the simultaneous resetting period.

In a seventh aspect of the present invention, the preceding method for driving a matrix type of plasma display panel is characterized in that the method further comprising the steps of, immediately before applying the scan pulse, applying a priming pulse to one of the paired row electrodes in the addressing period.

According to the method for driving a matrix type of plasma display panel of the present invention, the last pulse of the discharge-sustaining pulses in the sustained discharge period is adjusted to be shorter than that of the immediately previous pulse of the discharge-sustaining pulses and/or, while adjusting the generating, an address-pulse is applied to the column electrode in the simultaneous time of the applying of the discharge-sustaining pulses to generate the discharge between the paired row and column electrodes. Therefore, the residual wall charges remaining the lightened pixel cell and the darkened pixel cell are uniformed at the end of sustained discharge period so that a stable addressing operation and precise emission displaying associated with the pixel data is achieved in the next addressing period.

BRIEF DESCRIPTION OF THE DRAWING

The aforementioned aspects and other features of the invention are explained in the following description, taken in connection with the accompanying drawing figures wherein.

DESCRIPTION OF THE PREFERRED EMBODIMENTS

For a better understanding of the invention reference is made to the following detailed description of the preferred embodiments.

Figure 1:
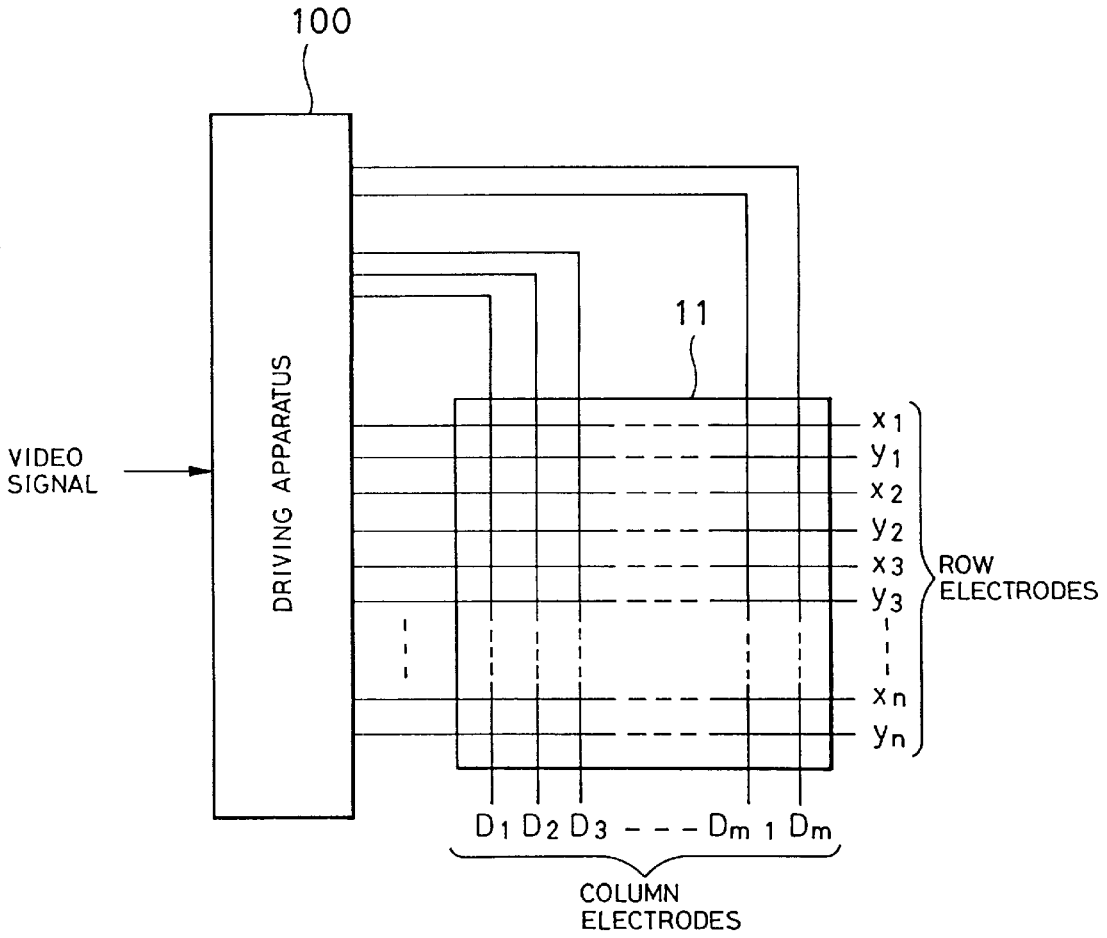
FIG. 1 is a schematic diagram showing a plasma display apparatus including a matrix type of plasma display panel.
Figures 2A, 2B, 2C, 2D, 2E:
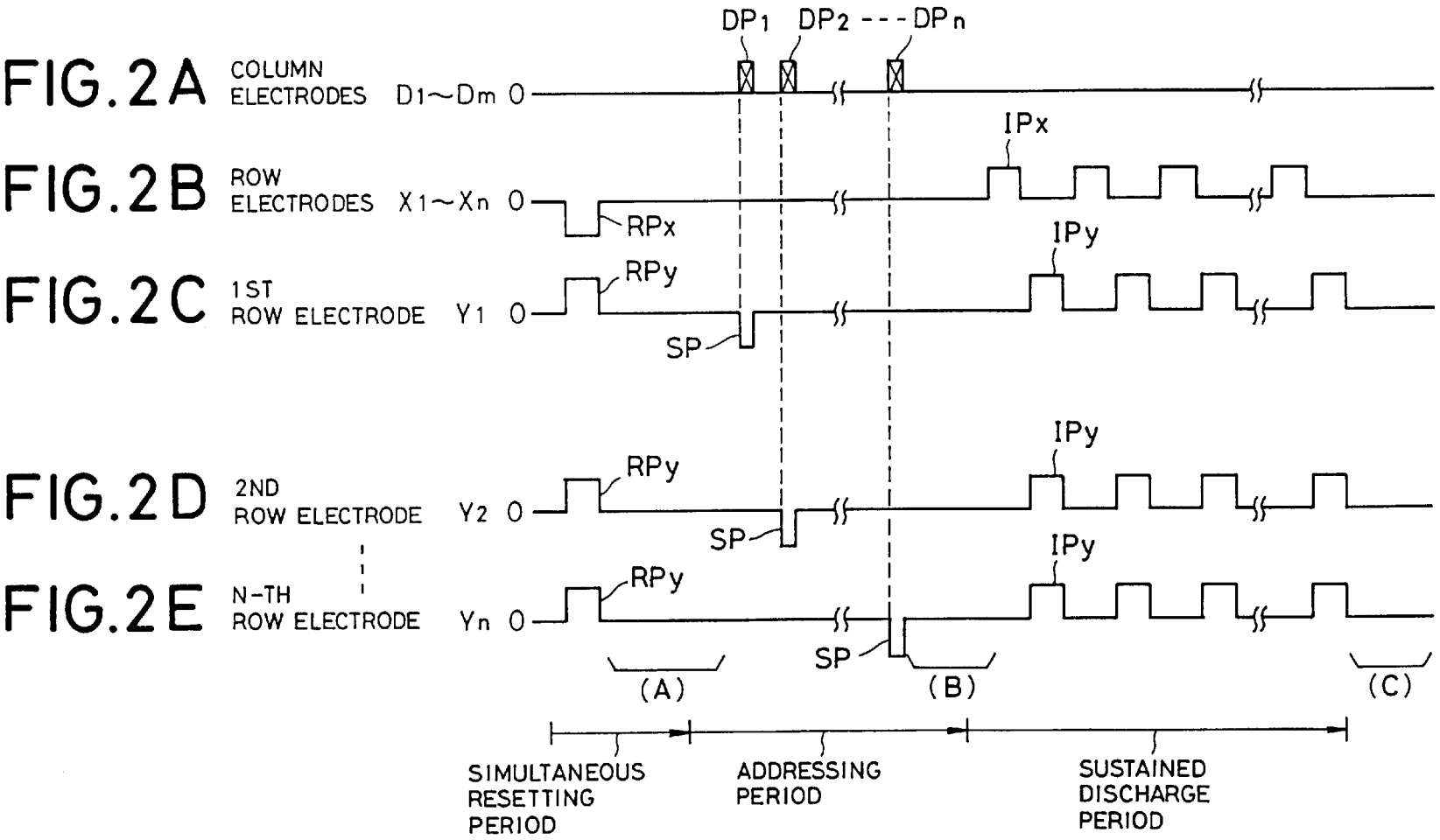
FIGS. 2A to 2E are waveform charts each showing the timing for applying a driving pulse to the respective electrode for driving a plasma display panel.
Figure 3A:
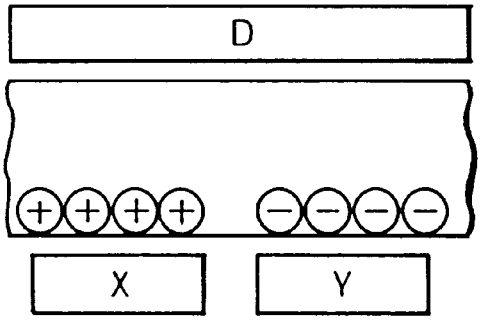
FIGS. 3A to 3C are cross-sectional diagrams for explaining the distribution of wall charges near row electrodes in a pixel cell with changes by repetitive applications of pulses.
Figure 3B:
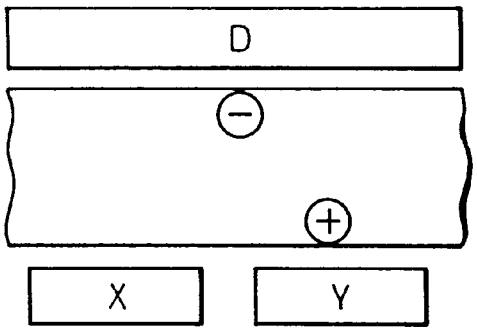
Figure 3C:
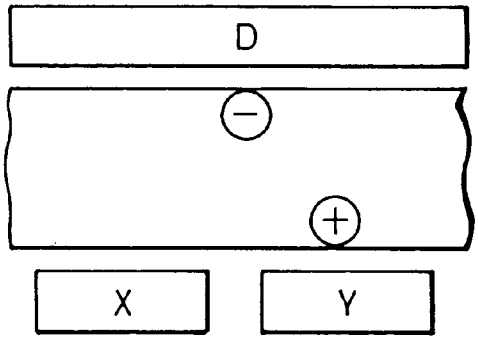
Figure 4A:
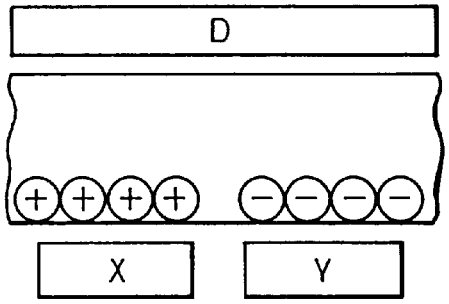
FIGS. 4A to 4C are cross-sectional diagrams for explaining the distribution of wall charges near row electrodes in a pixel cell with changes by repetitive applications of pulses.
Figure 4B:
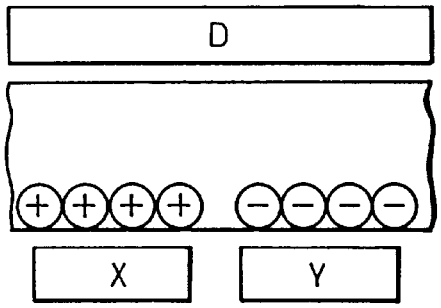
Figure 4C:
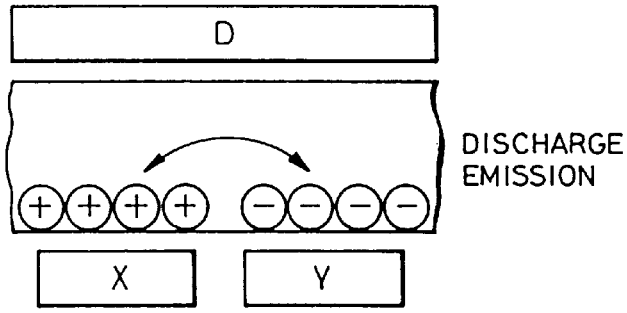
Figure 5:
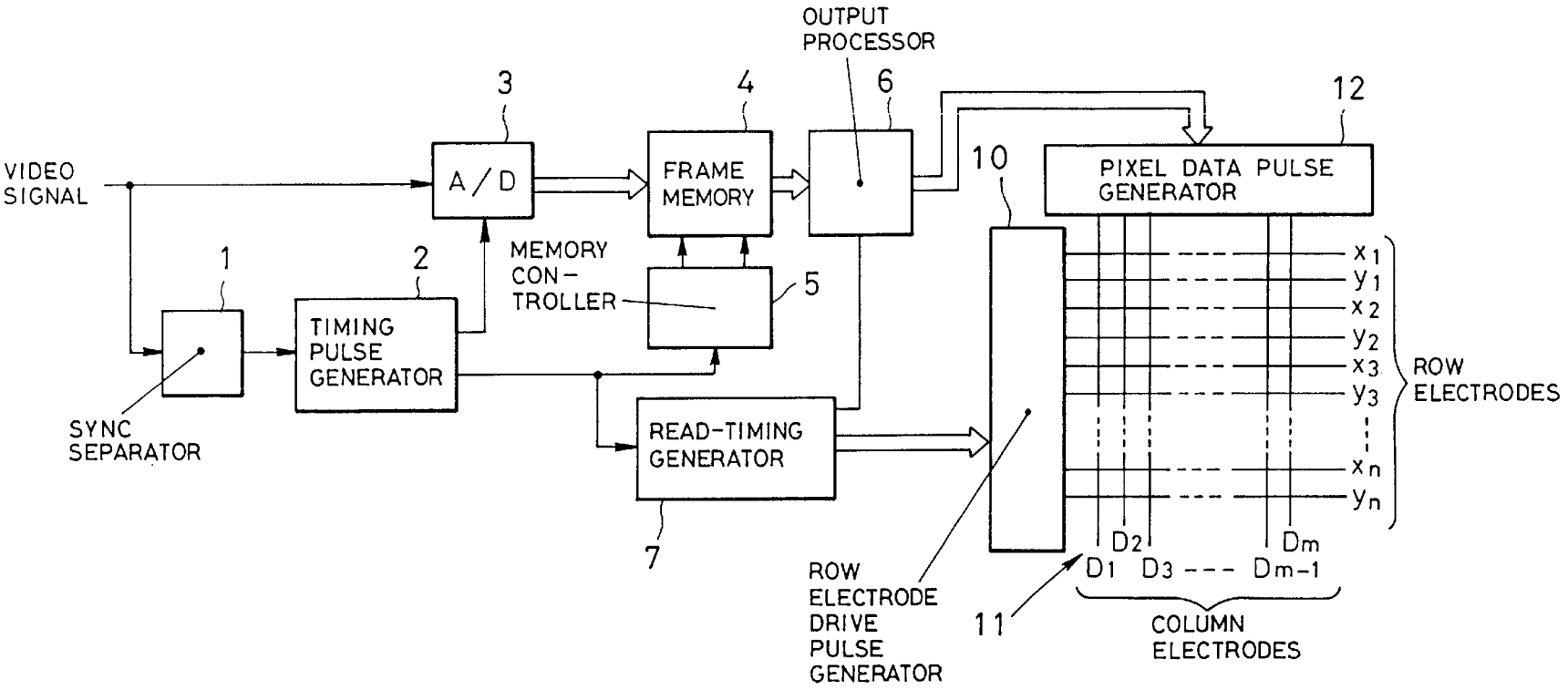
FIG. 5 is a block diagram showing a plasma display apparatus according to the invention.

FIG. 5 is a block diagram showing a plasma display apparatus including a driving apparatus for driving a plasma display panel by means of the driving technique according to the invention.

Referring to FIG. 5, a sync separator 1 receives input video signals and then extracts horizontal and vertical synchronous signals from the received input video signals to supply the extracted synchronous signals to a timing pulse generator 2. The timing pulse generator 2 produces an extracted synchronous signal timing pulse on the basis of the extracted horizontal and vertical synchronous signals to supply the produced extracted synchronous signal timing pulse to an A/D converter 3, a memory controller 5, and a read-timing signal generator 7.

The A/D converter 3 converts input video signals per pixel to digital pixel data synchronizing with the extracted synchronous signal timing pulse to provide the converted digital pixel data to a frame memory 4. The memory comptroller 5 supplies write and read pulses synchronous with the extracted synchronous-signal-timing-pulse to the frame memory 4.

The frame memory 4 receives pixel data supplied from the A/D converter 3 in turn in response to the received write signal. In addition, the frame memory 4 also reads out the pixel data which have been stored in the frame memory 4 in turn to supply the pixel data to an output processor 6.

The read-timing signal generator 7 generates various types of timing signals for controlling the operation for discharge emissions to supply these timing signal to a row electrode driving pulse generator 10 and the output processor 6. The output processor 6 receives the pixel data from the memory 4 to supply the received pixel data to a pixel data pulse generator 12 synchronizing with the timing signal from the read timing signal generator 7.

The pixel data pulse generator 12 receives pixel data supplied from the output processor 6 to generate the pixel data pulses DP1 to DP1n corresponding to the received pixel data, thereby applying the pixel data pulses to the column electrodes D1 to Dm in the PDP 11. In addition, the pixel data pulses generator 12 generates address-pulses AP and applies them to the column electrodes D1 to Dm at the same timing of applying of the discharge-sustaining pulses IPx and IPy to the row electrodes (described later).

The row electrode driving pulse generator 10 generates first and second resetting pulses RPx1 and RPy and a second resetting pulse RPx2 for compulsorily generating the discharge between all of the pair of row electrodes in the PDP 11 to produce charged particles in the discharge region of the PDP (described later), and further produces priming pulses PP to uniformly recover the charged particles in the pixel cells within the sustained discharge period, and further produces a scan pulse SP for writing the pixel data on the associated pixels, and further produces a series of discharge-sustaining pulses IPx and IPy for sustaining the discharge emissions in the pixel cell, so as to apply these pulses to the row electrodes X1 to Xn, and Y1 to Yn, in response to each of the various types of timing signal supplied from the read-timing signal generator 7.

Figure 6:
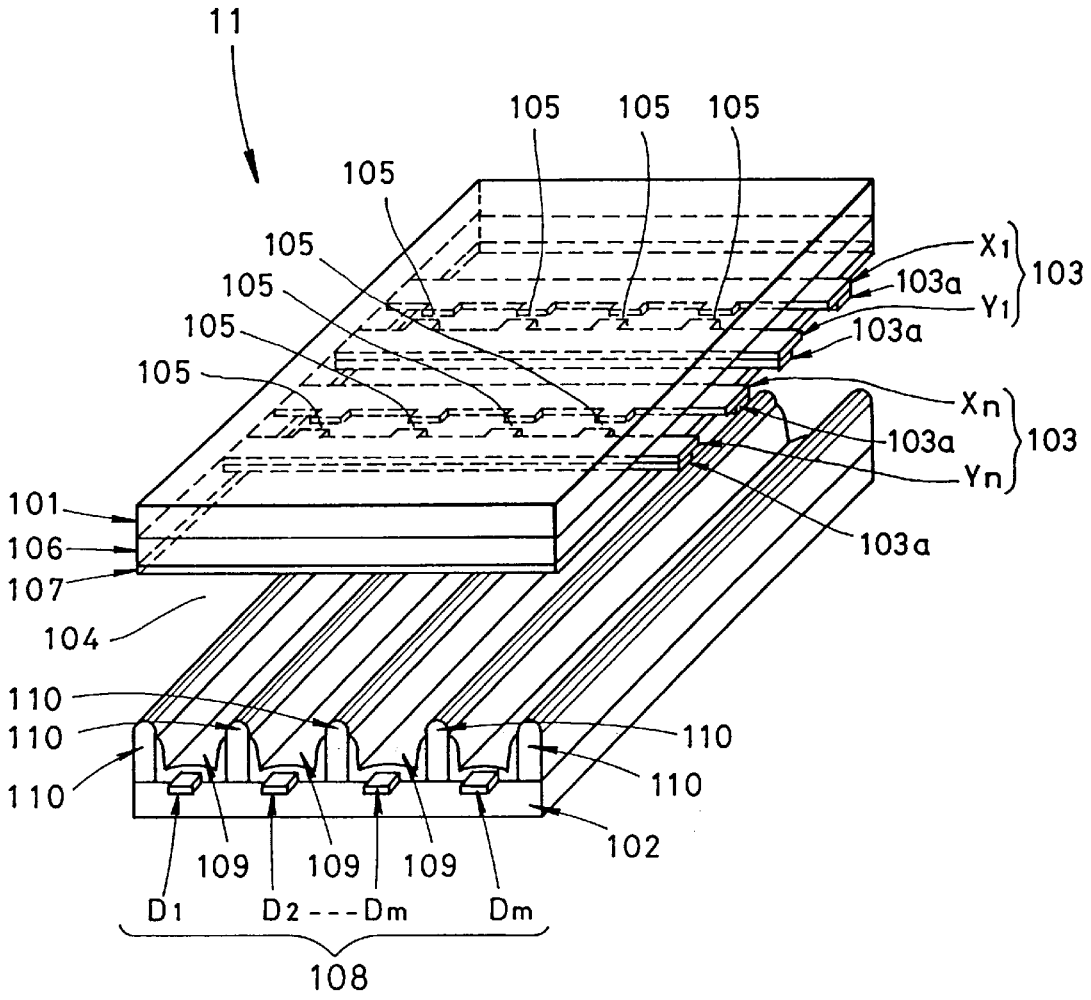
FIG. 6 is a partially enlarged perspective view showing a plasma display according to the invention.

FIG. 6 shows a schematic diagram of the construction of the PDP 11.

Referring to FIG. 6, a front face substrate 101 made of glass is arranged parallel to a back substrate 102 made of glass. The row electrodes X1 to Xn, and Y1 to Yn, each made of a transparent conductive film, are formed on an internal surface of the front substrate 101 which faces the back substrate 102 at an interval. A set of adjoining row electrodes Xi and Yi (1<i=<n) are arranged and extend parallel to each other to provide a pair of sustain electrodes 103 for sustaining the discharge as scanning lines. Each row electrode or sustain electrode 103 further comprises a bus electrode 103*a* made of a metal thin film which is formed on the transparent electrode portion 103 so as to extend along it to compensate for the conductivity of the transparent electrode portion 103. In other words, the paired sustain electrodes 103 are arranged in such a manner that the transparent electrode portion 103 with a relative high resistance is electrically connected to the bus electrode 103*a* extending together in the longitudinal direction thereof, and further have protrusions facing to each other across discharge gaps 105 each providing a center of emission of light in the pixel cell.

Each bus electrode 103*a* formed on the respective row electrodes has a surface area smaller than that of the transparent electrode portion 103 and positioned adjacent to the opposite side edge of the discharge gap 105. The row electrodes with the bus electrodes 103*a* are covered with a dielectric layer 106 made of glass with a low melting point. A MgO layer 107 made of magnesium oxide is deposited on the dielectric layer 106. The discharge space region 104 is provided between the MgO layer 107 and the back substrate 102 made of glass described later.

On the other hand, the column electrodes D1 to Dm i.e., address electrodes are formed parallel to each other at a predetermined interval on the internal side of the back glass substrate 102 in such a manner that the column electrodes are positioned perpendicular to the paired sustain electrodes 103 and spaced through the discharge space region 104 from the sustain electrodes 103 with fluorescent layer coverings for example R, G and B emissions. In addition, the column electrodes are covered with fluorescent layers 109 for example R, G and B emissions.

In the above back glass substrate 102, the address electrodes are partitioned by barrier ribs 110 extending parallel to each other and each having a predetermined height. In this arrangement, an intersection region defined between one of the paired row electrodes 103 of the front glass substrate 101 and one of the column or address electrodes 108 of the back glass substrate 102 provides a discharge emission cell as a pixel cell. The barrier ribs partition the pixel cells each having a predetermined area.

The fluorescent layers 109 are arranged between the barrier ribs 110 respectively. The discharge space region 104 is sandwiched between of internal sides of the front glass substrate 101 with the paired sustain electrodes 103 and the back glass substrate 102 with the address electrodes 108 and the fluorescent layers 109. Furthermore, the discharge space region 104 is filled with a discharge gas of mixture of neon and xenon and sealed with a pertinent member (not shown). In this way, PDP 11 which is driven by the method d for driving a surface discharge and matrix type of the embodiment according to the invention is constructed as described above.

Next, such a method for driving the surface discharge and matrix type PDP shown in FIG. 5 will be described hereinafter.

FIGS. 7A to 7E illustrate waveform charts each showing the timing for applying a driving pulse to the respective electrode for driving a plasma display panel apparatus according to the invention.

The row electrode driving pulse generator 10 shown in FIG. 5 applies first resetting pulses RPxl each having a negative voltage to the row electrodes X1 to Xn respectively at the same time and simultaneously applies the positive voltage the first resetting pulses RPy to the row electrodes Y1 to Yn respectively as shown in FIGS. 7A to 7E. Immediately after applying the first resetting pulses RPx1, the row electrode driving pulse generator 10 applies the second resetting pulse RPx2 to the row electrodes X1 to Xn respectively (simultaneous resetting step).

The application of the first resetting pulses RPx1, RPy causes the discharges between the paired row electrodes of PDP 11 as a whole. In this case, each of the first resetting pulses RPx1, RPy is set to include a pulse rise or pulse fall time longer than each duration of the discharge-sustaining pulse so that the discharge emission non-related to the displaying due to a short resetting pulse is suppressed in order to improve the contrast. The discharge caused by the first resetting pulse is faint. Therefore, the amounts of the wall charges are different to each other in the pixel cells. However, the discharge emission caused by application of the second resetting pulses RPx2 uniformly equalizes the wall charges of the respective pixel cells.

Figures 7A, 7B, 7C, 7D, 7E:
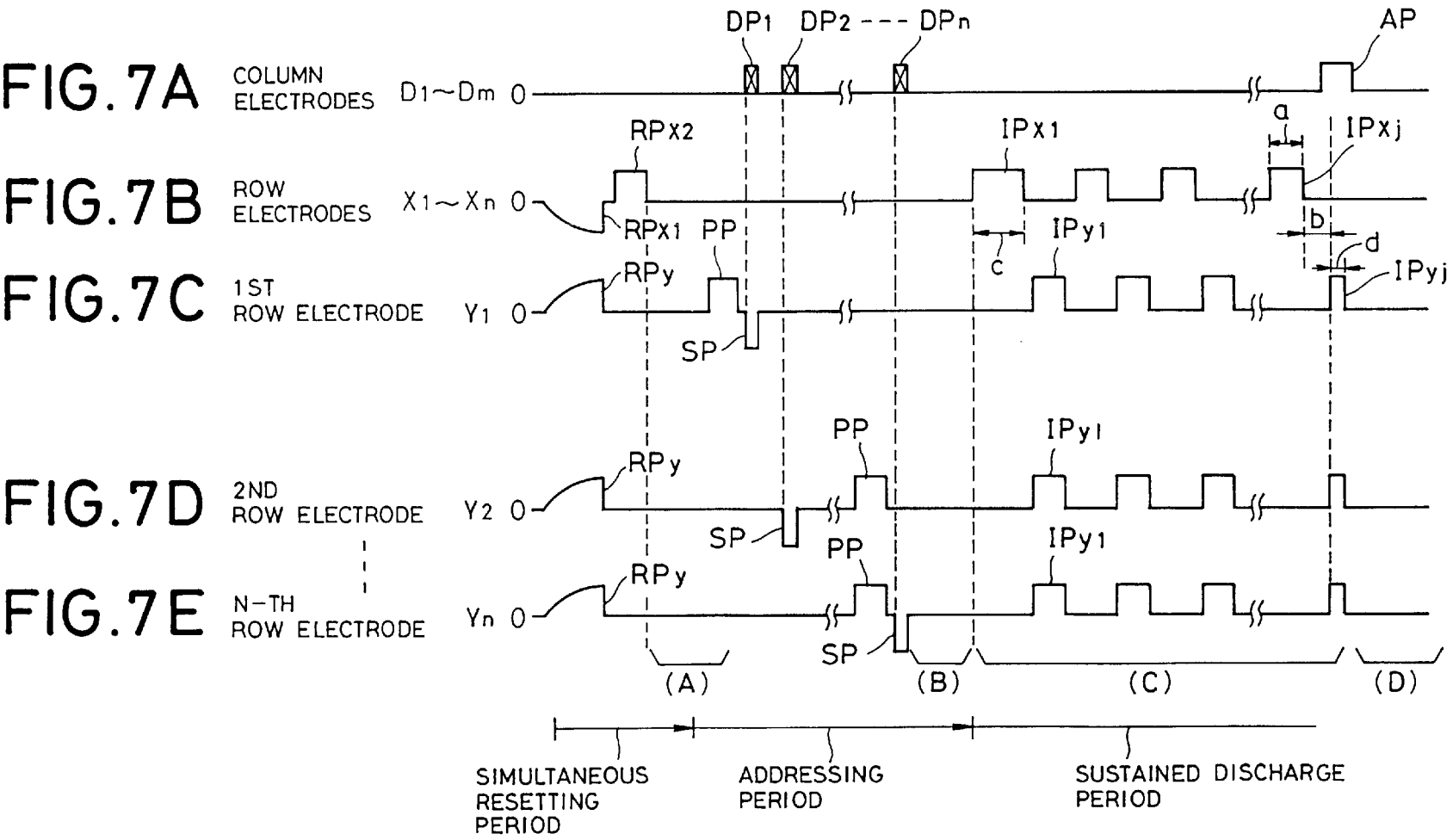
FIGS. 7A to 7E are waveform charts each showing the timing for applying a driving pulse to the respective electrode for driving a plasma display panel apparatus according to the invention.
Figure 8A:
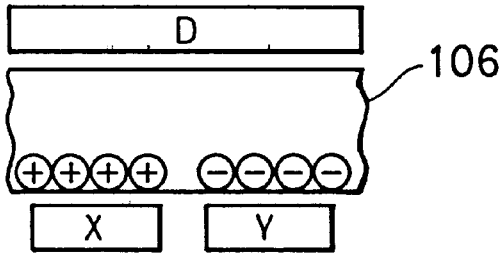
FIGS. 8A to 8D are cross-sectional diagrams for explaining the distribution of wall charges near row electrodes in a pixel cell with changes by repetitive applications of pulses according to the invention.
Figure 9A:
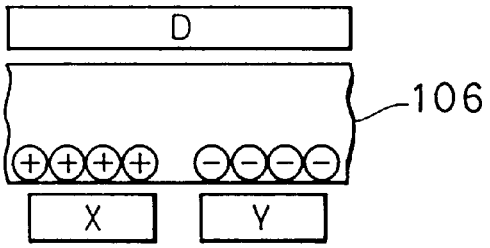
FIGS. 9A to 9D are cross-sectional diagrams for explaining the distribution of wall charges near row electrodes in a pixel cell with changes by repetitive applications of pulses according to the invention.

During such a simultaneous resetting step in the period (A) shown in FIGS. 7A to 7E, the positive wall charges and the negative voltage wall charges are produced at the sides of the row electrodes X1 to Xn and the row electrodes Y1 to Yn under the dielectric layer 106 in the every pixel cell of PDP 11, as shown in FIG. 8A or FIG. 9A.

Next, the row electrodes driving pulse generator 10 applies the pixel data pulses DP1 to DPn corresponding to pixel data at every row to the column electrodes D1 to Dm in turn. In this case, these pixel data pulses DP1 are pulses of the number of "m" corresponding to pixel data for ranging from the first column to the m-th column in the first row. The pixel data pulses DP2 are pulses of the number of "m" corresponding to pixel data for ranging from the first column to the m-th column in the first second row.

Such pixel data pulses of "m" pieces in number corresponding to pixel data are applied to the column electrodes D1 to Dm at the same time respectively. In this case, the positive voltage pixel data pulses are applied to the column electrodes to have contents of the pixel data equal to a logical value "0", while any voltage pixel data pulses is not applied to the column electrodes to have contents of the pixel data equal to a logical value "1". The row electrodes driving pulse generator 10 generates the scan pulse SP at the same timing of applications of the pixel data pulses DP1 to DPn and then applies them in turn to the row electrodes Y1 to Yn, thereby to perform to write the pixel data to every row. In addition, immediately before the application of the scan pulse SP, the positive voltage priming pulses PP have been applied to the row electrodes Y1 to Yn. By the priming pulses, the amounts of the wall charges for priming in the discharge space region are equalized in the pixel cells (addressing period).

Figure 8B:
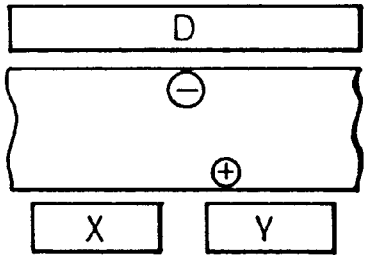

In the addressing period, the scan pulse SP and the positive voltage pixel data pulse DP may be simultaneously applied to the row and column electrodes Y, D in the pixel cell (darkened) respectively and then such a pixel cell is discharged and excited, so that most of the wall charges which has been generated by simultaneous resetting step disappears. As a result, in the period (B) appearing in FIGS. 7A to 7E respectively, a very small amount of the positive wall charges remains at the side of the row electrodes Y and, a very small amount of the negative voltage wall charges remains at the side of the column electrodes D as shown in FIG. 8B.

Figure 9B:
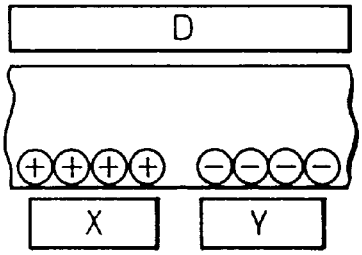

On the contrary, the wall charges which have been generated by the simultaneous resetting step charges may remain at the row electrodes as they are as shown in FIGS. 9B even in the addressing period for writing the pixel data pulses, when only the scan pulses SP are applied to the row electrodes but any pixel data pulse is not applied to the column electrodes so that no discharge occurs at the pixels (lightened).

Next, after the addressing period, the row electrode driving pulse generator 10 repeatedly applies a series of positive voltage discharge-sustaining pulses IPx to the row electrodes X1 to Xn, while repeatedly applying a series of other positive voltage discharge-sustaining pulses IPy to the row electrodes Y1 to Yn at a timing offset from those of the former discharge-sustaining pulses IPx. The only pixel cells in the wall charge state shown in FIG. 9B maintain the discharge emissions which hold the wall charge, but the other pixel cells of FIG. 8B do not emit light (sustained discharge period).

It is noted that the pulse width of the first discharge-sustaining pulses IPx1 (the reference letter "C" shown in FIG. 7B) which is firstly applied to the row electrode X in the sustained discharge period is set to be longer than those of the latter discharge-sustaining pulses applied. This feature reduces the occurrence of the uneven amounts of the wall charges for priming of the respective row electrodes in the beginning of the sustained discharge period. Further, in the sustained discharge period shown in FIGS. 7B and 7C, the pulse width "d" of the discharge-sustaining pulses IPyj lastly applied to the row electrode Y is set to be shorter than those of the former discharge-sustaining pulses. This feature reduces the occurrence of the uneven amounts of the wall charges for priming of the respective row electrodes in the beginning of the next resetting period.

In the sustained discharge period shown in FIGS. 7C, 7D and 7E, not only the discharge-sustaining pulses with the shorter pulse width IPyj are lastly applied to the row electrodes Y1 to Yn, but also the pulse widths of the discharge-sustaining pulses IPxj lastly applied to the row electrodes X1 to Xn may be set to be shorter than those of the former discharge-sustaining pulses, under the conditions that the last applied discharge-sustaining pulses are set on the row electrodes X1 to Xn in the sustained discharge.

The pixel data pulses generator 12 generates address-pulses AP and applies them to the column electrodes D1 to Dm at the same timing of applying of the last discharge-sustaining pulse IPyj to the row electrode. The address-pulse AP has the same polarity as the other discharge-sustaining pulses.

When the discharge-sustaining pulse IPyj with a shorter pulse with and an address-pulse AP are simultaneously applied to the cell at the last of the sustained discharge period in the period (B) shown in FIGS. 7A to 7E, a discharge occurs and terminates quickly in the lightened pixel cell with the wall charge state shown in FIG. 9B, because of the short pulse width of the discharge-sustaining pulse IPyj. The wall charges therefore are hardly produced on the row electrodes X1 to Xn, and Y1 to Yn. On the other hand, a faint discharge current flows on the column electrodes D1 to Dm by the application of the address-pulse AP, so that a small amounts of wall charges is formed.

Figure 9C:
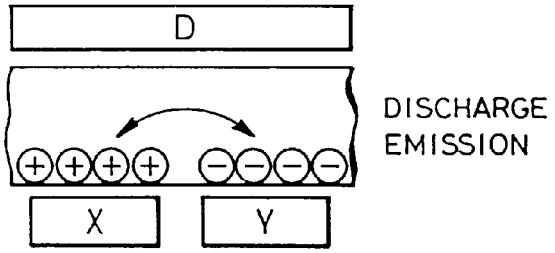
Figure 9D:
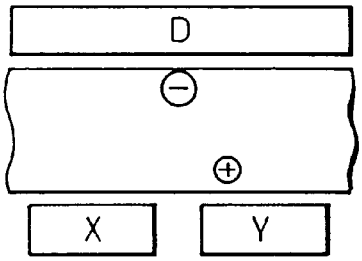

In other words, the pixel cells in the wall charge state shown in FIG. 9B maintain the discharge emissions which hold the wall charges as shown in FIG. 9C in the period (B) shown in FIGS. 7A to 7E while being are discharged and excited by every application of discharge-sustaining pulses IPx and IPy, after that the wall charges finally settle in the state as shown in FIG. 9D.

Figure 8C:
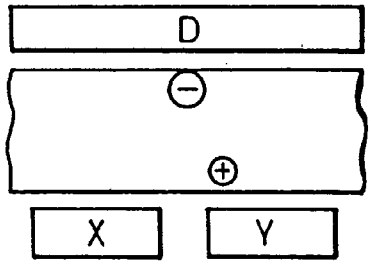

However the pixel cells in the wall charge state shown in FIG. 8B do not emit light in the sustained discharge period even by every application of the discharge-sustaining pulses IPx and IPy and the address-pulse AP, because the wall charges are insufficient to the discharge and excitation. Such pixel cells hold the wall charge state shown in FIG. 8B and maintain them during the sustained discharge period as shown in FIG. 8C and after that the wall charges finally settle in the state as shown in FIG. 8D.

Figure 8D:
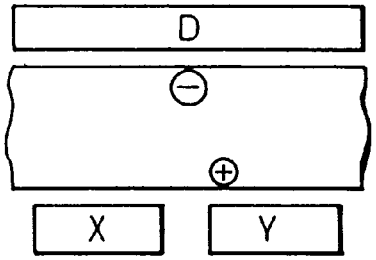

In this way, the wall charge states on the row electrodes X1 to Xn, and Y1 to Yn and column electrodes D1 to Dm in the pixel cells of PDP 11 are substantially the same as shown in FIGS. 8D and 9D at the end of the sustained discharge period. Therefore, the residual wall charges in both the lightened pixel cell and the darkened pixel cell equalized to each other. Since the wall charges accumulated in the all cells are substantially equalized at the beginning of the next simultaneous resetting step, the PDP 11 can provide an accurate displaying image in accordance with the given pixel data.

In addition, the wall charge state of the lightened pixel cell caused by the application of discharge-sustaining pulses IPyj and an address-pulse AP at the last of the sustained discharge period is depend on the pulse width "d" of the discharge-sustaining pulses IPyj applied lastly to the electrode. Since the PDPs to be manufactured are different in the discharge starting time and the discharge intensity, such properties should be optimized in the regulation of the width of last pulse. According to the invention, the width "a" of the previous pulse IPxj applied immediately before the discharge-sustaining pulse IPyj applied lastly to the electrode is adjusted in the sustained discharge period as shown in FIG. 7B. Further, an interval "b" between the end of the immediately previous pulse IPxj and the beginning of the last pulse IPyj may be adjusted in the sustained discharge period as shown in FIGS. 7B and 7C. In other words, the regulation of the pulse width and/or the interval at the end of the discharge-sustaining pulse series may be changeable for the optimization.

As described above, in the method for driving a matrix type of plasma display panel according to the present invention, the last pulse of the discharge-sustaining pulses in the sustained discharge period is adjusted to be shorter than that of the immediately previous pulse of the discharge-sustaining pulses and/or, while adjusting the generating of pulses, the address-pulse is applied to the column electrode in the simultaneous time of the applying of the discharge-sustaining pulses to generate the discharge between the paired row electrodes and column. Therefore, the residual wall charges remaining the lightened pixel cell and the darkened pixel cell are uniformed at the end of sustained discharge period so that a stable addressing operation and precise emission displaying associated with the pixel data is achieved in the next addressing period.

What is claimed is:

1. A method for driving a matrix type of plasma display panel displaying an image, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel, said method comprising the steps of:

applying selectively a pixel data pulse to the column electrode while synchronously applying a scan pulse to every pair of row electrodes to write pixel data to the associated pixels for selecting a pixel cell to be lightened or darkened in accordance with pixel data pulses applied for an addressing period; and applying a series of discharge-sustaining pulses alternately to one of the paired row electrodes and the other thereof to maintain sustained discharge between the pair of row electrodes and the lightened or darkened pixel cell for a sustained discharge period wherein a width of a last pulse of the discharge-sustaining pulses applied in the sustained discharge period shorter than that of an immediately previous pulse in the sustained discharge period;

applying an address-pulse to the column electrode at the same time the last discharge-sustaining pulse is applied to generate a discharge between the paired row electrodes and the column electrode.

2. A method according to claim 1, wherein said address-pulse has the same polarity of said discharge-sustaining pulse.

3. A method according to claim 1 further comprising the steps of adjusting the width of the previous pulse applied immediately before the last discharge-sustaining pulse finally applied in the sustained discharge period; and adjusting an interval between the end of the immediately previous pulse and the beginning of the last pulse.

4. A method according to claim 1 method further comprising the steps of, before the addressing period, applying a first resetting pulses to all of the row electrodes simultaneously to cause discharges between all of the pairs of row electrodes to make the wall charges in the pixel cells, each first resetting pulse including a pulse rise or pulse fall time longer than each duration of the discharge-sustaining pulse as a simultaneous resetting period.

5. A method according to claim 4, wherein the wall charges formed in the simultaneous resetting step are selectively deleted by applying both the scan pulse and the pixel data in the addressing to select the lightened pixel cell and the darkened pixel cell.

6. A method according to claim 4 further comprising the steps of, immediately after applying the first resetting pulse, applying a second resetting pulse to one of the paired row electrodes in the simultaneous resetting period.

7. A method according to claim 4 further comprising the steps of, immediately before applying the scan pulse, applying a priming pulse to one of the paired row electrodes in the addressing period.

* * * * *